US010240421B2

(12) United States Patent
Bell et al.

(10) Patent No.: US 10,240,421 B2
(45) Date of Patent: Mar. 26, 2019

(54) STRING SHOT BACK-OFF TOOL WITH PRESSURE-BALANCED EXPLOSIVES

(71) Applicants: William T. Bell, Huntsville, TX (US); James G. Rairigh, Houston, TX (US)

(72) Inventors: William T. Bell, Huntsville, TX (US); James G. Rairigh, Houston, TX (US)

( * ) Notice: Subject to any disclaimer, the term of this patent is extended or adjusted under 35 U.S.C. 154(b) by 0 days.

(21) Appl. No.: 15/760,171

(22) PCT Filed: Sep. 18, 2015

(86) PCT No.: PCT/US2015/051060
§ 371 (c)(1),
(2) Date: Mar. 14, 2018

(87) PCT Pub. No.: WO2017/048292
PCT Pub. Date: Mar. 23, 2017

(65) Prior Publication Data
US 2018/0258723 A1 Sep. 13, 2018

(51) Int. Cl.
*F42D 1/05* (2006.01)
*E21B 29/02* (2006.01)
*E21B 31/107* (2006.01)

(52) U.S. Cl.
CPC ..... *E21B 31/1075* (2013.01); *E21B 29/02* (2013.01); *F42D 1/05* (2013.01)

(58) Field of Classification Search
CPC ..... E21B 19/16; E21B 29/02; E21B 17/06; E21B 31/1075; E21B 23/04; E21B 43/1185; F42D 1/05
See application file for complete search history.

(56) References Cited

U.S. PATENT DOCUMENTS 2,911,909 A * 11/1959 Fuchs ..... E21B 31/1075 166/63
2,970,647 A * 2/1961 Scott ..... E21B 43/263 166/300
2,980,017 A 4/1961 Castel
3,150,590 A 9/1964 Silverman
3,517,740 A * 6/1970 Johnson ..... E21B 29/02 166/54.5
4,537,255 A * 8/1985 Regalbuto ..... E21B 31/1075 166/297
4,836,109 A * 6/1989 Wesson ..... E21B 43/1185 102/205
4,969,525 A * 11/1990 George ..... E21B 43/116 102/319
5,027,708 A 7/1991 Gonzalez et al.
5,293,940 A * 3/1994 Hromas ..... E21B 43/116 166/297

(Continued)

*Primary Examiner* — Jennifer H Gay

(57) ABSTRACT

A "back-off" tool comprises a magazine cylinder having one distal end of a long mast rod secured to the lower end-face of a magazine cylinder. The magazine cylinder is attached to an electrically detonated firing head. A first plurality of blind hole cavities penetrate the magazine cylinder end-face around the mast rod junction. A second plurality of elongated detonation cord ends are inserted into high temperature grease filled magazine cylinder cavities. From the cavities, the detonation cord lengths are bound to the rod surface along the rod length by non-metallic cord. The tool assembly is secured to the end of a wireline or tubing string for downhole placement and detonation.

28 Claims, 3 Drawing Sheets

(56) References Cited

U.S. PATENT DOCUMENTS

| | | | | |
|---|---|---|---|---|
| 5,386,780 | A * | 2/1995 | Klein | E21B 43/1185 102/275.3 |
| 2012/0160491 | A1* | 6/2012 | Goodman | E21B 29/02 166/297 |
| 2015/0007994 | A1* | 1/2015 | Lancaster | E21B 43/1185 166/297 |
| 2015/0107819 | A1* | 4/2015 | Hofman | E21B 43/263 166/63 |
| 2016/0356132 | A1* | 12/2016 | Burmeister | B01D 61/20 |
| 2017/0175499 | A1* | 6/2017 | Prisbell | E21B 43/116 |
| 2017/0198560 | A1* | 7/2017 | Mace | F42D 1/08 |
| 2018/0258723 | A1* | 9/2018 | Bell | E21B 29/02 |

* cited by examiner

STRING SHOT BACK-OFF TOOL WITH PRESSURE-BALANCED EXPLOSIVES

CROSS-REFERENCE TO RELATED APPLICATION

The present application is a domestic application that claims priority to International PCT Application No. PCT/US2015/051060, filed Sep. 18, 2015, having the title of "String Shot Back-Off Tool With Pressure-Balanced Explosive," which is incorporated in its entirety herein.

FIELD

The present invention relates, generally, to the equipment and processes for deep well drilling. More particularly, the invention is directed to methods and/or apparatus for unthreading or decoupling a specific pipe or casing joint from a downhole string of pipe.

BACKGROUND

Rotary drilling of deep wells for the production of fluid minerals, such as oil and gas, relies upon long assemblies of pipe called "strings." Each separate pipe unit or section for this purpose normally is in the order of 9 to 12 meters (30 to 40 feet) in length and threaded at each end.

Drill pipe, which forms the primary pipe string for advancing the bore hole depth and often provides rotational torque to the drill bit, is usually fabricated with tapered external threads at one end and tapered internal threads at the opposite end. Drill pipe external threads are formed into a heavy tool joint called a "pin" that is welded to the one end of a pipe section. Internal drill pipe threads are formed into a complementary tool joint called a "box" that is welded to the opposite pipe end.

"Oil field" casing and tubing pipe are usually formed with external threads at both ends of a pipe section. Two sections of pipe can be joined together by a short length (close) coupling having internal threads at opposite ends.

In the course of downhole operations, such pipe strings occasionally become tightly stuck in a well. Typically, the bore hole walls of a loose or unstable geological strata, penetrated by the drill string, "sluffs" or collapses into the borehole around the drill string and above the bit. Such a wall collapse may occur for hundreds or even thousands of feet along the borehole length. In such an event, it is impossible to withdraw the drill string from the borehole or, in most cases, even rotate the drill string.

Often, it is desirable to retrieve as much of the pipe string above the seizure point as possible. In any case, it is essential to extract the drill string above the seizure point to enable further operations. However, simply reversing the rotation of the pipe string will not necessarily separate the string at the first threaded joint above the seizure. As additional pipe sections are added to a string, the earlier assembled joints become tighter and more difficult to unthread and separate. Consequently, without some focused intervention, an upper threaded joint will normally disassemble before a lower joint.

There are numerous existing methods and devices for locating the seizure point in a pipe string. The method and apparatus taught by U.S. Pat. No. 7,383,876 is representative of existing technology. After locating the specific joint above the seizure point, the traditional method used to effect release of the threaded assembly at that specific joint is to apply a gentle or moderate "left hand" torque to the pipe string, as the specific joint is shocked or "jarred" by a nearby explosion.

Explosive devices for urging the release of threaded joints, which are joined together, have heretofore been made in various forms. Typically, a "back-off tool", as such devices are characterized in the well drilling arts, comprises detonation cord, such as "Primacord", which is a flexible tube filled with a suitable high explosive that is set off by an electrically initiated detonator. When used under low temperature and pressure conditions, prior art "back-off" tools and methods have produced generally satisfactory results. However, in extremely deep wells, temperatures are in the order of 200° C. or greater, and the pressures are several thousand pounds per square inch, thereby presenting the prior art apparatus and methods with serious functional and reliability issues.

A need exists for a back-off tool that is usable and reliable in deep well environments, which include exposure to fluids and increased wellbore pressures, for the unthreading (e.g., unscrewing, decoupling) of joints of tubulars (e.g., drill pipe, casing).

A need exists for a back-off tool that is usable and reliable in deep well environments where high pressures and high temperatures within the wellbore result in difficult explosive transfers between detonators and explosives, and especially where such back-off tools are configured to utilize the ambient pressure to facilitate and advantage the detonation characteristics.

The present invention meets this need.

SUMMARY OF THE INVENTION

The present invention relates generally to a "back-off" tool with pressure balanced explosives, which comprises a firing head, a magazine cylinder and a shot string. Operationally, the tool is suspended at the distal end of a wireline or coiled tubing string, for example, for downhole positioning and detonation control while the drilling rig rotary table simultaneously imposes a "mild" or "moderate" degree of torque in the "left-hand", "un-screw" or "thread separation" rotational direction on the drill string.

The firing head can house a detonator, (e.g., an electrically initiated detonator) that can be secured within an axial cavity. The detonator can comprise a small quantity of explosive enclosed within an axial projection.

The magazine cylinder assembles with the firing head to position a booster explosive (such as an explosive pellet) in detonation proximity with the detonator projection. A plurality of cavities bored into the lower end-face of the magazine cylinder is aligned in a circle around the cylinder axis. The cavities can penetrate the magazine cylinder to detonation proximity with the booster explosive and can be initially filled with a grease (e.g., a high temperature grease).

The shot string can comprise a metallic mast rod (e.g., a steel rod), of about 3 meter (10 foot) in length, for example, that can be secured by welding or by a threaded socket at its upper distal end to the center of the lower end face of the magazine cylinder. The distal ends of a plurality of detonation cords can be inserted into the magazine cylinder cavities to displace a corresponding volume of grease. The detonation cord lengths can be extended along the mast rod length and bound tightly to the rod surface by a wrapping of non-metallic binder cord. However, the lower distal ends of the detonation cords remain free to longitudinal displacement along the mast rod surface as an accommodation to high downhole temperature and pressure. Secured to the distal end of the mast rod can be a guide head having an outside diameter greater than the perimeter of overlaid detonation cords. Significantly, the magazine cylinder can be fabricated of a brittle, frangible metal that shatters into relatively small particles upon detonation of the detonator cords.

The number of detonation cords, essential for an assured joint back-off of a particular joint size at a particular joint depth in the presence of well fluid of a particular density, is determined from an empirical tabulation of corresponding explosive weight distributed per unit length, which usually can be expressed in g/m or grains/ft.

In an embodiment of the present invention, the downhole back-off tool can comprise a firing head that can include an explosive detonator, and a magazine cylinder that can house a booster explosive and a plurality of detonation cord cavities, wherein the magazine cylinder can be secured to the firing head. The downhole back-off tool can further include an elongated mast rod, which can be secured at one end thereof to the magazine cylinder, and a plurality of elongated detonation cords. At least one of the plurality of elongated detonation cords can have an end thereof, inserted into a respective one of the plurality of detonation cord cavities, and a remaining length thereof secured along the elongated mast rod.

In an embodiment, the magazine cylinder can include a cylindrical end-face with the elongated mast rod secured thereto, and the plurality of detonation cord cavities can penetrate the cylindrical end-face around the elongated mast rod. In an embodiment, the plurality of detonation cord cavities can be blind pockets that can include fluid barrier bulkheads between the plurality of detonation cord cavities and the booster explosive. The fluid barrier bulkheads can be formed from the bottoms of the plurality of detonation cord cavities, and these bottoms can have various shapes, including a spherical shape.

In an embodiment, the plurality of detonation cord cavities can be within ignition proximity of the booster explosive, and the cavities can be filled with high temperature grease, wherein the plurality of detonation cord cavities, which are receiving the end of at least one of the plurality of detonation cords, are displaced by a corresponding volume of the high temperature grease.

In an embodiment of the back-off tool, the plurality of elongated detonation cords can be secured to the elongated mast rod by non-metallic cord, a helical net, or other cords or netting. In an embodiment, the number of the detonation cavities can equal or exceed the number of the elongated detonation cords.

Embodiments of the present invention can include a method of assembling a downhole back-off tool, wherein the steps of the method can include providing a firing head comprising a detonator sub and a magazine cylinder, providing a booster explosive in the detonator sub, providing a plurality of cavities in a distal end-face of the magazine cylinder, and securing one end of an elongated mast rod to the distal end-face of the magazine cylinder. The method can further include the steps of providing a plurality of elongated detonation cords, inserting a distal end of each elongated detonation cord into a respective magazine cavity within detonation proximity of the booster explosive, and securing a remaining length of the plurality of elongated detonation cords to the mast rod, and along a length of the mast rod.

In an embodiment of the method for assembling a downhole back-off tool, grease can be placed in at least one of the respective magazine cavities. The grease can be a high temperature grease. In an embodiment, the grease can be displaced, or partially displaced, from the respective magazine cavities upon insertion of the distal ends of the detonation cords into the respective magazine cavities.

In an embodiment of the method for assembling a downhole back-off tool, a fluid barrier can be provided between a bottom end of the respective magazine cavities and the booster explosive, and the bottom ends can have various shapes, including a concave shape.

Embodiments of the present invention can include methods usable for releasing a threaded pipe joint within a pipe string, wherein the methods can comprise the step of assembling a back-off tool, which can include a firing head; a detonator magazine comprising a booster explosive, which can be initiated by the firing head, and a plurality of cavities; a mast rod having one end secured to the detonator magazine; and a plurality of elongated detonation cords. The steps of the method can continue by inserting one distal end of each detonator cord into a respective cavity of the detonator magazine for location within detonation proximity of said booster explosive, securing a remaining length of the detonator cords along a length of the mast rod, positioning the back-off tool within a flow bore of the pipe string and adjacent to the threaded pipe joint within the pipe string, and applying a mild torque in a thread separation direction, at one end of the pipe string. The method can conclude with the step of detonating the booster explosive for releasing the threaded pipe joint within the pipe string as discussed.

Embodiments of the present invention can include a method of releasing an intended threaded pipe joint within a pipe string, which includes the steps of securing one end of an elongated mast rod to a magazine cylinder comprising a booster explosive and a first plurality of cavities, and tabulating a value representing a weight of an explosive that is distributed over a unit length of detonation cord corresponding to various parameters, including a type of pipe, a size of pipe, a well depth location of an intended threaded pipe joint, and a density of fluid within a well, such that when the explosive is detonated adjacent to the intended threaded pipe joint, while under moderate torque, the release or probable release of the threaded pipe can be initiated. The method can continue with the steps if selecting a second plurality of elongated detonation cords that correspond to the tabulated value for the intended threaded pipe joint and the well depth location within a flow bore of the intended pipe string, which is adjacent to the intended threaded pipe joint. The, the steps of the method can include inserting distal ends, which are respective to one or more of the selected plurality of elongated detonation cords, into respective magazine cylinder cavities, and applying a moderate torque, in a thread separation direction, to the pipe string while simultaneously detonating the selected plurality of elongated detonation cords for the release of the intended threaded pipe joint.

In an embodiment, the method steps can include securing the distal ends of the selected plurality of elongated detonation cords within ignition proximity of the booster explosive. In an embodiment, the steps of the method can include filling the plurality of cavities with high temperature grease, prior to inserting the distal ends of the selected plurality of elongated detonation cords into the cavities.

Embodiments of the present invention can include an embodiment of a downhole back-off tool that includes a firing head comprising an explosive detonator in ignition proximity to an initiation explosive, a plurality of detonation cord cavities in a distal end of the firing head, which can be distributed about an elongated mast rod secured to the firing head distal end, and a plurality of elongated detonation cords. In an embodiment, at least one of the plurality of elongated detonation cords can have an end thereof inserted into a respective one of the plurality of detonation cord cavities, in initiation proximity with the initiation explosive, and a remaining length thereof secured along the elongated mast rod.

In an embodiment of the back-off tool, a primer explosive can be disposed in a radial boring between the explosive detonator and the initiation explosive, and the initiation explosive can be a distribution ring having initiation proximity to a plurality of detonation cord ends.

In an embodiment of the back-off tool, a fluid barrier bulkhead can be positioned between the detonator and the initiation explosive. In an embodiment, the fluid barrier bulkhead can be disposed between the explosive detonator and the radial boring.

DRAWINGS

Relative to the drawings wherein like reference characters designate like or similar elements or steps through the several figures of the drawings.

DETAILED DESCRIPTION OF THE EMBODIMENTS

As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate. Moreover, in the specification and appended claims, the terms "pipe", "tube", "tubular", "casing", "liner" and/or "other tubular goods" are to be interpreted and defined generically to mean any and all of such elements without limitation of industry usage.

Figure 1:
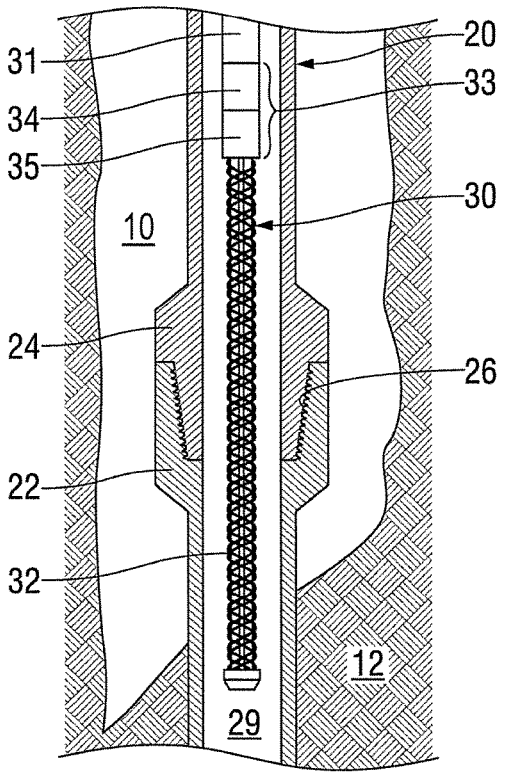
FIG. 1 represents a section of a raw borehole having a drill string inserted therein and the present invention in place within the drill string flow bore.

To illustrate the operational environment of the invention, reference is given to the sectional view of FIG. 1 showing a portion of a drill pipe string 20 suspended in a raw borehole 10. As shown in FIG. 1, below the box joint 22, the drill pipe string 20 is immovably seized by a bore wall collapse 12. Following the drill pipe seizure, an immediate operational objective of the well drilling management is to locate the seizure point and de-couple the threaded drill pipe joint assembly 26, between the first box 22 and pin 24 assembly and above the seizure point 12.

After having located the threaded drill pipe joint assembly 26, which is above the seizure point 12, preferably the first joint above the seizure point, the present back-off tool 30 can be suspended within the drill pipe flow bore 29 by an appropriate suspension string, such as a wire line, a slick line or, as illustrated, from a length of coiled tubing 31. A suitable connection mechanism, such as a bail or threads, not shown in FIG. 1, can be used to secure the back-off tool 30 to the end of the suspension string 31. The back-off tool 30 can be positioned to locate the string-shot elements 32 in a bridging opposition of the specifically identified, threaded drill pipe joint assembly 26.

As shown in FIG. 1, secured between the coiled tubing 31 and the string shot elements 32 is a firing head 33, which can comprise a detonator sub 34 and a detonation cord magazine 35 (e.g., a seven (7) string detonation cord magazine).

Figure 5:
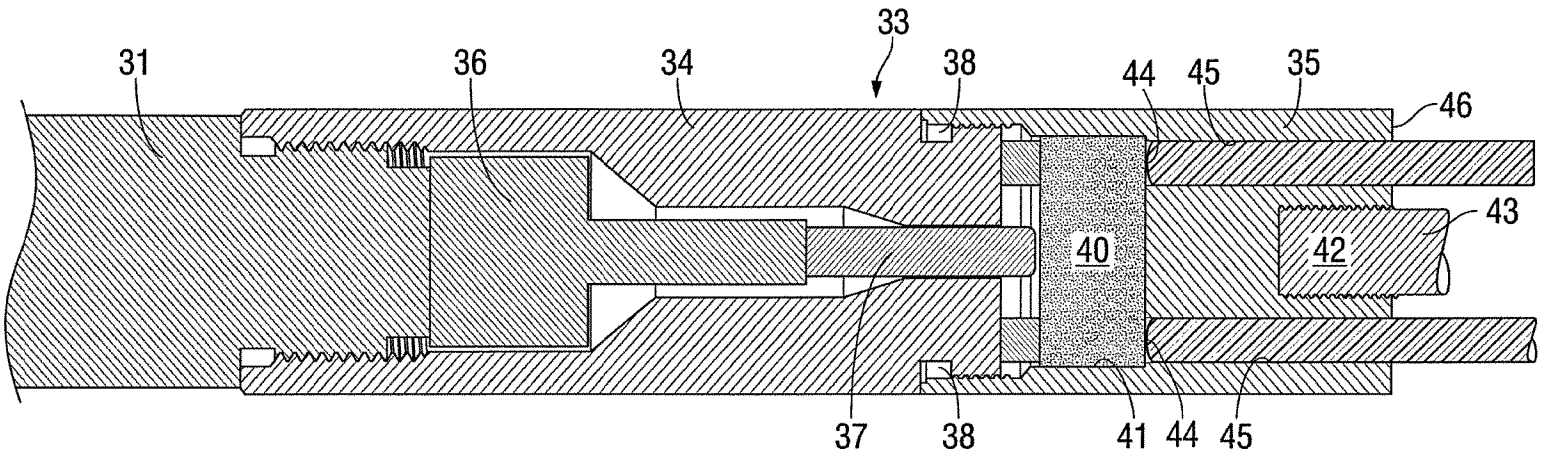
FIG. 5 is a sectioned side view of the firing head and magazine cylinder of the string shot back-off tool.

Referring to FIG. 5, the detonator sub 34 can house an electrical ignition circuit 36, which can be used for igniting an electrically initiated detonator 37. As shown in FIG. 5, the detonator 37 can project from the end of the sub 34 into an "ignition proximity" with a booster explosive 40 (such as an explosive pellet) of a relatively large size that can be encapsulated in a booster cavity 41 of the detonation cord magazine 35. "Ignition proximity" is that distance between a particular detonator and a particular receptor explosive within which ignition of the detonator will initiate detonation of the receptor explosive. A sealing member 38, for example an O-ring 38, can be used to seal the booster cavity 41 from potential well fluid contamination.

Figure 4:
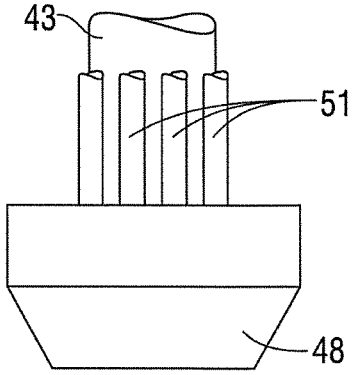
FIG. 4 is a detail of the lower distal end of the mast rod terminating in a guide foot of the string shot back-off tool.

As shown in FIG. 5, the lower end of the cylindrical detonation cord magazine 35 includes a threaded socket 42 for securing, for example, a 3 meter (10 foot) long steel mast rod 43. As shown in FIG. 4, the lower distal end of the mast rod 43 is terminated by a guide foot 48 to protect the detonation cords 51 during a well descent. Referring back to FIG. 5, around the magazine threaded socket 42 are shown a plurality of detonation cord cavities 45 that penetrate the cylindrical detonation cord magazine 35, from the lower end face 46. The blind pockets are of sufficient depth to secure the detonation cord 51 ends within ignition proximity of the booster explosive 40 in the booster cavity 41.

As shown in FIG. 5, the bulkheads 44, which are the terminal bottom ends of the blind pockets 45, are spherically radiused concavities. These concave pocket bottoms (i.e., bulkheads 44) effectively function as shaped charge liners Upon detonation of the booster explosive 40, each bulkhead 44 collapses, similarly to a shaped charge liner, to amplify and focus the energy output of the booster explosive 40 upon the respective detonation cords 51.

Traditionally, the detonator 37 is enclosed with the detonation cords 51 by use of a rubber boot. Historically, back-off tools of such a traditional design have had trouble making an explosive transfer between the detonator and the detonator cord, particularly when exposed to well fluids, and especially at high wellbore pressures. The present invention includes a back-off tool and methods of use that allow a booster explosive 40 to be protected from exposure to the well fluid environment and the back-off tool incorporates a booster explosive 40 that can be as large as is necessary to ignite the detonation cords 51, including through the fluid barrier bulkhead(s) 44.

Figure 7:
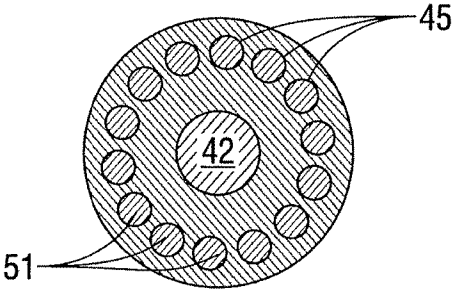
FIG. 7 is an end view of a cylindrical detonation cord magazine comprising fourteen (14) detonation cords within fourteen (14 detonation cord cavities.
Figure 6:
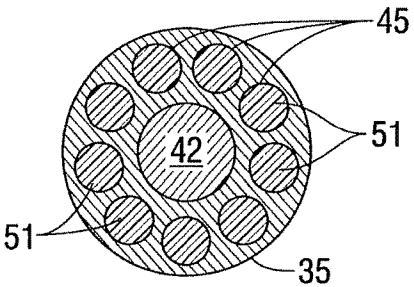
FIG. 6 is an end view of a cylindrical detonation cord magazine comprising nine (9) detonation cords within nine (9) detonation cord cavities.

The selection of the number of detonation cord cavities 45 will normally depend on the specific application or range of applications for the back-off tool 30, as will be subsequently explained. The embodiment of the present invention, as shown in FIG. 5, includes detonation cord cavities 45 (also shown in FIGS. 6 and 7). Alternative embodiments of detonation cord magazines may include any number of detonation cord cavities, including the nine detonation cord cavities 45 shown in FIG. 6, and up to or exceeding the fourteen (14) detonation cord cavities 45 shown in FIG. 7, to secure a maximum charge using 21.2 g/m (100 grains/ft) detonation cord. FIGS. 6 and 7 each show a cylindrical detonation cord magazine 35, which includes a threaded socket 42 with varying numbers of detonation cords 51 inserted into the detonation cord cavities 45, placed around the threaded socket 42.

Continuing with reference to FIG. 5, the detonation cord cavities 45 can be initially filled with a high temperature grease, such as 315° C. heat rated silicon grease. Into each of these grease filled detonation cord cavities 45, one distal end of a detonation cord 51 can be inserted to displace a volume of grease corresponding to the volume of the inserted detonation cord 51. Several important functions are served by the grease. Firstly, the grease tends to protect the detonation cord ends from well fluid contamination. Most importantly, however, the grease protects the explosive within the detonation cords 51 from well pressure compaction. High degrees of compaction, as imposed upon the detonation cord 51 by thousands of pounds per square inch of well pressure, tend to desensitize explosives, such as HMX, to detonation. The grease insulation around the detonation cord 51 pocket or cavity 45 end greatly reduces such well pressure compaction and preserves the ignition sensitivity.

Figure 2:
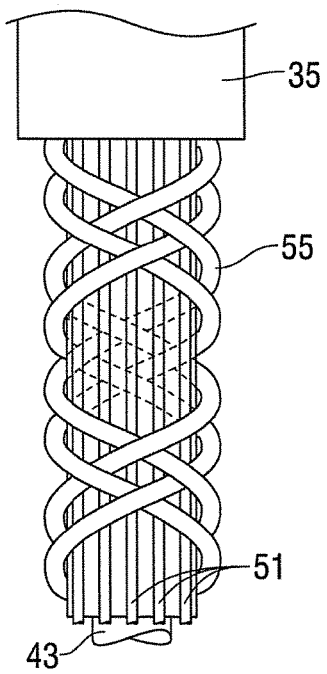
FIG. 2 is an enlarged detail of the upper section of the string shot subassembly and the lower section of the magazine cylinder subassembly.
Figure 3:
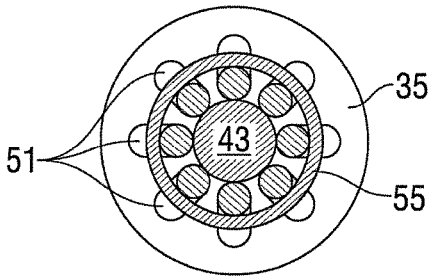
FIG. 3 is a sectioned end view of the FIG. 2 detail viewed along the cutting plane III-III of FIG. 2.

From the detonation cord cavities 45, the trailing lengths of several detonation cords 51 of a magazine 35 are bound firmly to the surface of mast rod 43, as illustrated by FIGS. 2 and 3, preferably by non-metallic binder cord. For example, as shown in FIGS. 2 and 3, the detonation cords 51 may be secured to the mast rod 43 by a woven tube in the form of a helical net 55 of non-metallic cordage or a non-metallic cord 55. Such a helical net may be formed as multiple leads of reversely turned helices.

Prior to the addition of a guide foot 48 to the downhole end of the mast rod 43, the woven tube 55 can be collapsed to expand the central aperture of the woven tube 55. In the collapsed condition, the woven tube 55 can be drawn over the length of several detonation cords 51, while held against the surface of the mast rod 43. Upon placement of the guide foot 48, the woven tube 55 can be expanded longitudinally over and along the length of the detonation cords 51. This longitudinal expansion of the woven tube 55 can constrict the tube aperture and bind the detonation cords 51 tightly against the surface of the mast rod 43. Significantly, the lower ends of the detonation cords 51 are allowed displacement in the axial direction along the surface of the mast rod 43. Such displacement freedom is required to accommodate the downhole well pressure and temperature consequences on the exposed detonation cords 51, as described above. As the back-off tool 30 descends into the deeper depths of a well, increasing fluid pressure in the well bears upon the exposed detonation cords 51 to compact the explosive therein. With increased compaction, the detonation cord length decreases. As such, at least one end of the detonation cord length must be free to accommodate the length reduction.

It should be understood that the detonation cords 51 may be secured to the mast rod 43 surface by any of many binding methods, such as hand wrapping with single strand cord or even tape. A helical net 55 is merely one form of a woven tube that can be well adapted to the present invention.

Figure 8:
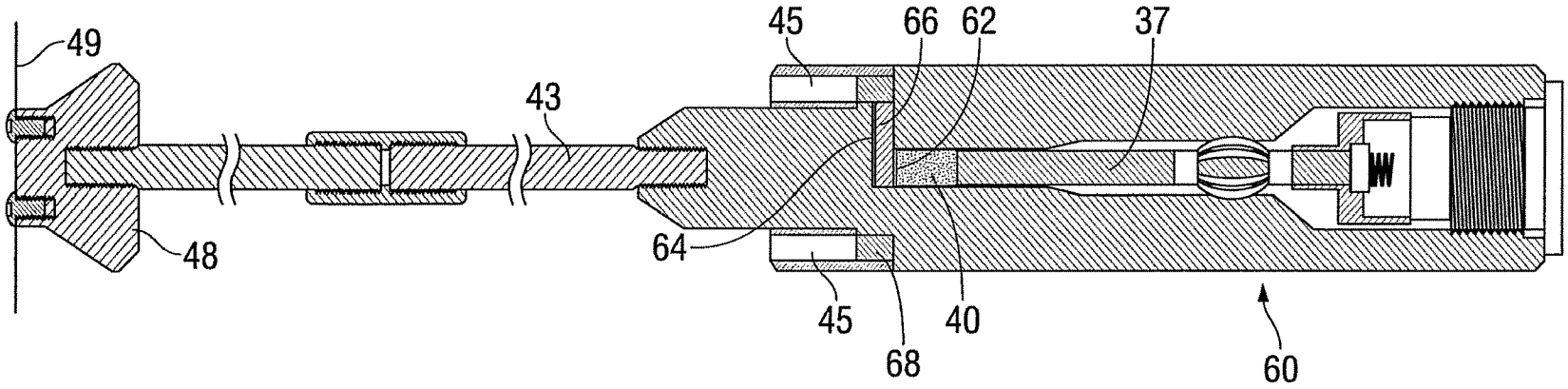
FIG. 8 is a sectioned side view of an alternative embodiment of the firing head of the present invention.

An alternative embodiment of the invention is illustrated by FIG. 8. Similar to the FIGS. 1 and 4 embodiment, the FIG. 8 embodiment provides a steel mast rod 43 terminated by a guide foot 48. Preferably, a centralizer 49 is secured to the distal end of the guide foot for centralizing the tool 30 within the drill pipe string 20.

The embodiment shown in FIG. 8 offers a more compact structure of a firing head 60, wherein the booster explosive 40 can detonate a column of primer explosive 66 that can be confined within a radial boring 64. A fluid barrier bulkhead 62 can be used to separate the booster explosive 40 from the primer explosive 66. At the outer terminus of the primer explosive 66, a ring of initiation explosive 68 is shown. The detonation cords (not shown) can be seated within the detonation cord cavities 45 and secured within ignition proximity of the ring of initiation explosive 68.

Experimentation and testing in the field has led to the development of empirical ranges of explosive values that can be useful for determining an explosive value effective for a particular back-off task. For example, in the selection process, the nominal size of the tubing, the well depth of the seizure, and the fluid density of the in situ well fluid can be determined for use in calculations of the amount of explosive needed. From these known parameters, an explosive weight distribution value per unit of length can be determined for shocking a tubing coupling, to disassemble the coupling of the tubing. Notably, the determined value is a distributed explosive value of detonation cord. When the detonation cord discharges, the resulting shock is a relatively low grade expansion, occurring within the tubing bore and along the detonation cord length, across the coupling joint.

"Moderate" or "mild" torque, as applied herein, is a highly subjective value determined in each case by the driller. Although most, if not all, modern drilling rigs have reasonably precise torque measuring capacity, which can be highly variable; however, the torque measuring capacity can also be very specific to a particular type of pipe, e.g. casing, drill pipe or tubing, and can be sufficient to unthread (i.e., unscrew) a particular joint under back-off shock, but not unthread any other joint in the string. Hence, the value of "mild" or "moderate" torque is a subjective operational value recognized by those of skill in the art for the particular equipment they are working with.

Although the invention disclosed herein has been described in terms of specified and presently preferred embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention.

The invention claimed is:

1. A downhole back-off tool comprising:

a firing head comprising an explosive detonator;

a magazine cylinder housing a booster explosive and a plurality of detonation cord cavities, wherein the magazine cylinder is secured to the firing head;

an elongated mast rod secured at one end thereof to the magazine cylinder; and a plurality of elongated detonation cords, wherein at least one of the plurality of elongated detonation cords has an end thereof inserted into a respective one of the plurality of detonation cord cavities, and a remaining length thereof secured along the elongated mast rod.

2. The back-off tool as described by claim 1, wherein the magazine cylinder comprises a cylindrical end-face with the elongated mast rod secured thereto, and wherein the plurality of detonation cord cavities penetrate the cylindrical end-face around the elongated mast rod.

3. The back-off tool as described by claim 1, wherein the plurality of detonation cord cavities are blind pockets comprising fluid barrier bulkheads between the plurality of detonation cord cavities and the booster explosive.

4. The back-off tool as described by claim 3, wherein the fluid barrier bulkheads are formed from bottoms of the plurality of detonation cord cavities.

5. The back-off tool as described by claim 4, wherein the bottoms of the plurality of detonation cord cavities formed into fluid carrier bulkheads are spherical.

6. The back-off tool as described by claim 3, wherein the plurality of detonation cord cavities are within ignition proximity of the booster explosive.

7. The back-off tool as described by claim 1, wherein the plurality of detonation cord cavities are filled with a high temperature grease.

8. The back-off tool as described by claim 7, wherein the plurality of detonation cord cavities receiving the end of at least one of the plurality of detonation cords are displaced by a corresponding volume of the high temperature grease.

9. The back-off tool as described by claim 1, wherein the plurality of elongated detonation cords is secured to the elongated mast rod by a non-metallic cord.

10. The back-off tool as described by claim 1, wherein the plurality of elongated detonation cords is secured to the elongated mast rod by a helical net.

11. The back-off tool as described by claim 1, wherein the explosive detonator is electrically initiated.

12. The back-off tool as described by claim 1, wherein a number of the plurality of detonation cavities equals or exceeds a number of the plurality of elongated detonation cords.

13. A method of assembling a downhole back-off tool, comprising the steps of:

providing a firing head comprising a detonator sub and a magazine cylinder;

providing a booster explosive in said detonator sub;

providing a plurality of cavities in a distal end-face of said magazine cylinder;

securing one end of an elongated mast rod to said distal end-face of said magazine cylinder;

providing a plurality of elongated detonation cords;

inserting a distal end of each elongated detonation cord into a respective magazine cavity within detonation proximity of said booster explosive; and securing a remaining length of said plurality of elongated detonation cords to said mast rod along a length of said mast rod.

14. The method of claim 13, wherein a grease is placed in at least one of said respective magazine cavities.

15. The method of claim 14, wherein insertion of said distal ends of said detonation cords into said respective magazine cavities partially displaces said grease from said respective magazine cavities.

16. The method of claim 13, wherein a fluid barrier is provided between bottom ends of said respective magazine cavities and said booster explosive.

17. The method of claim 16, wherein said bottom ends of said respective magazine cavities are concave.

18. A method of releasing a threaded pipe joint within a pipe string comprising the steps of:

assembling a back-off tool having a firing head, a detonator magazine comprising an explosive booster initiated by said firing head and a plurality of cavities, a mast rod having one end secured to said detonator magazine and a plurality of elongated detonation cords;

inserting one distal end of each detonator cord into a respective cavity of said detonator magazine for location within detonation proximity of said explosive booster;

securing a remaining length of said detonator cords along a length of said mast rod;

positioning said back-off tool within a flow bore of said pipe string and adjacent to said threaded pipe joint within said pipe string;

applying torque in a thread separation direction at one end of said pipe string; and detonating said explosive booster.

19. The method of claim 18, further comprising the step of filling one or more of the plurality of cavities with a high temperature grease.

20. The method of claim 19, wherein the step of inserting one or more distal ends of the plurality of elongated detonation cords into respective magazine cavities further comprises the step of displacing a volume of the high temperature grease therein.

21. A method of releasing an intended threaded pipe joint within a pipe string comprising the steps of;

securing one end of an elongated mast rod to a magazine cylinder comprising a booster explosive and a plurality of cavities;

tabulating a value representing a weight of an explosive distributed over a unit length of detonation cord corresponding to a type of pipe, a size of pipe, a well depth location of an intended threaded pipe joint, and a density of fluid within a well, such that when the explosive is detonated adjacent to the intended threaded pipe joint, while under moderate torque, the release of said threaded pipe is initiated;

selecting a plurality of elongated detonation cords corresponding to the tabulated value for said intended threaded pipe joint and said well depth location within a flow bore of said intended pipe string adjacent to said intended threaded pipe joint;

inserting distal ends respective to one or more of the selected plurality of elongated detonation cords into respective magazine cylinder cavities; and applying a torque in a thread separation direction to the said pipe string simultaneously with detonating the selected plurality of elongated detonation cords for release of said intended threaded pipe joint.

22. The method of claim 21, wherein the step of inserting said distal ends of the selected plurality of elongated detonation cords further comprises securing said distal ends of the selected plurality of elongated detonation cords within ignition proximity of the booster explosive.

23. The method of claim 22, further comprising the step of filling the plurality of cavities with a high temperature grease, prior to inserting said distal ends of said selected plurality of elongated detonation cords.

24. A downhole back-off tool comprising:

a firing head comprising an explosive detonator in ignition proximity to an initiation explosive;

a plurality of detonation cord cavities in a distal end of said firing head, distributed about an elongated mast rod secured to said firing head distal end; and a plurality of elongated detonation cords, wherein at least one of the plurality of elongated detonation cords has an end thereof inserted into a respective one of the plurality of detonation cord cavities in initiation proximity with said initiation explosive and a remaining length thereof secured along the elongated mast rod.

25. The back-off tool as described by claim 24, wherein a primer explosive is disposed in a radial boring between said explosive detonator and said initiation explosive.

26. The back-off tool as described by claim 25, wherein a fluid barrier bulkhead is disposed between said explosive detonator and said radial boring.

27. The back-off tool as described by claim 24, having a fluid barrier bulkhead between said explosive detonator and said initiation explosive.

28. The back-off tool as described by claim 24, wherein said initiation explosive is a distribution ring having initiation proximity to ends of a plurality of detonation cords.

* * * * *